United States Patent [19]

Ross, Jr. et al.

[11] 3,938,731

[45] Feb. 17, 1976

[54] RECEPTACLE FOR WASTE MATERIAL

[75] Inventors: Thorvald S. Ross, Jr., Manchester; Leonard P. Entin, Wayland, both of Mass.

[73] Assignee: Thorvald S. Ross, Jr., Beverly, Mass.

[22] Filed: Aug. 16, 1973

[21] Appl. No.: 388,994

Related U.S. Application Data

[62] Division of Ser. No. 138,482, April 29, 1971, Pat. No. 3,779,157.

[52] U.S. Cl. ..... 229/54 R; 229/44 R; 229/52 B; 229/62

[51] Int. Cl..... B65d 33/08; B65d 5/46; B65d 25/30

[58] Field of Search ..... 229/62, 44 R, 54 R, 52 B, 229/DIG. 2, DIG. 3, DIG. 4; 150/1.7

[56] References Cited

UNITED STATES PATENTS

| | | | |
|---|---|---|---|
| 1,631,521 | 6/1927 | Crowell | 229/DIG. 2 |
| 1,726,740 | 9/1929 | Joffe | 229/54 R |
| 2,037,770 | 4/1936 | Driver | 229/62 |
| 2,178,730 | 11/1939 | Stein | 229/62 X |
| 2,406,791 | 9/1946 | Belcher | 229/62 X |

FOREIGN PATENTS OR APPLICATIONS

| | | |
|---|---|---|
| 647,751 | 12/1950 | United Kingdom |

*Primary Examiner*—William I. Price
*Assistant Examiner*—Stephen P. Garbe
*Attorney, Agent, or Firm*—Kenway & Jenney

[57] ABSTRACT

A receptacle for receiving, compacting, storing, segregating, and eventual disposal of the compacted trash. It comprises an outer holder, and inner removable and disposable container, an overlying combined funnel and cover, the funnel opening into the top of the disposable container, and the cover being pivoted to the funnel so as to be swung outwardly therefrom, and being provided with a hole through which a manually actuated compactor or ram may be inserted for crushing the trash.

5 Claims, 16 Drawing Figures

FIG. 1
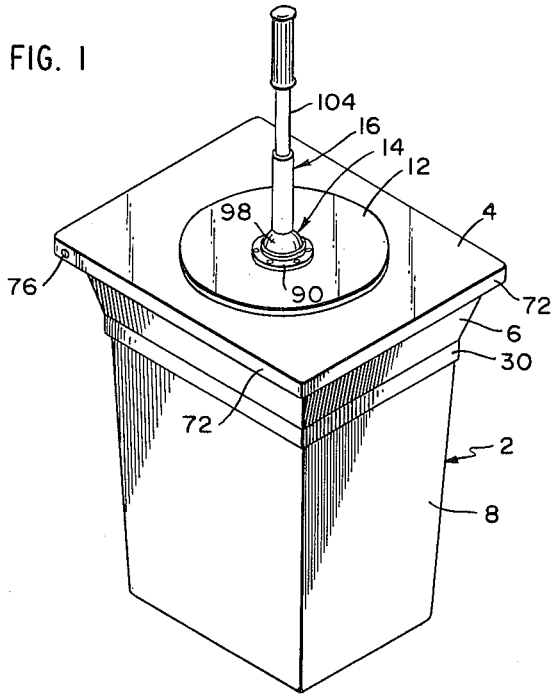
FIG. 4
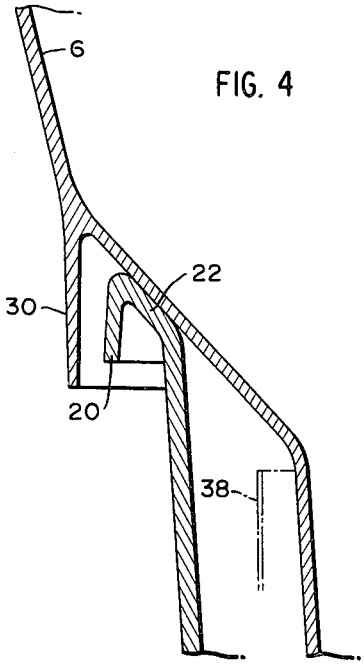
FIG. 5
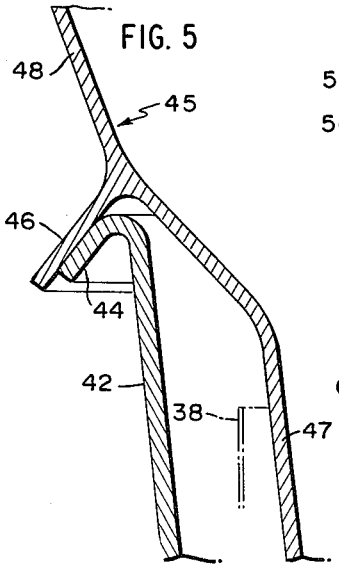
FIG. 6
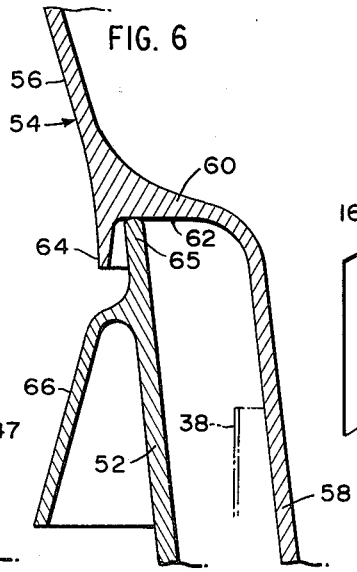
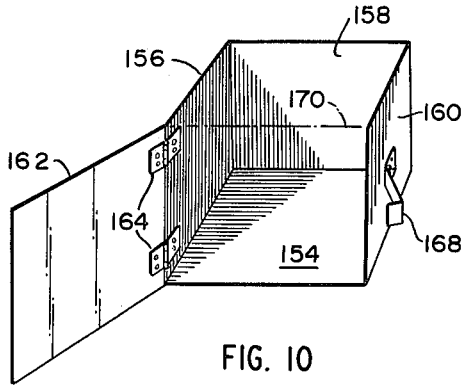
FIG. 10

FIG. 3
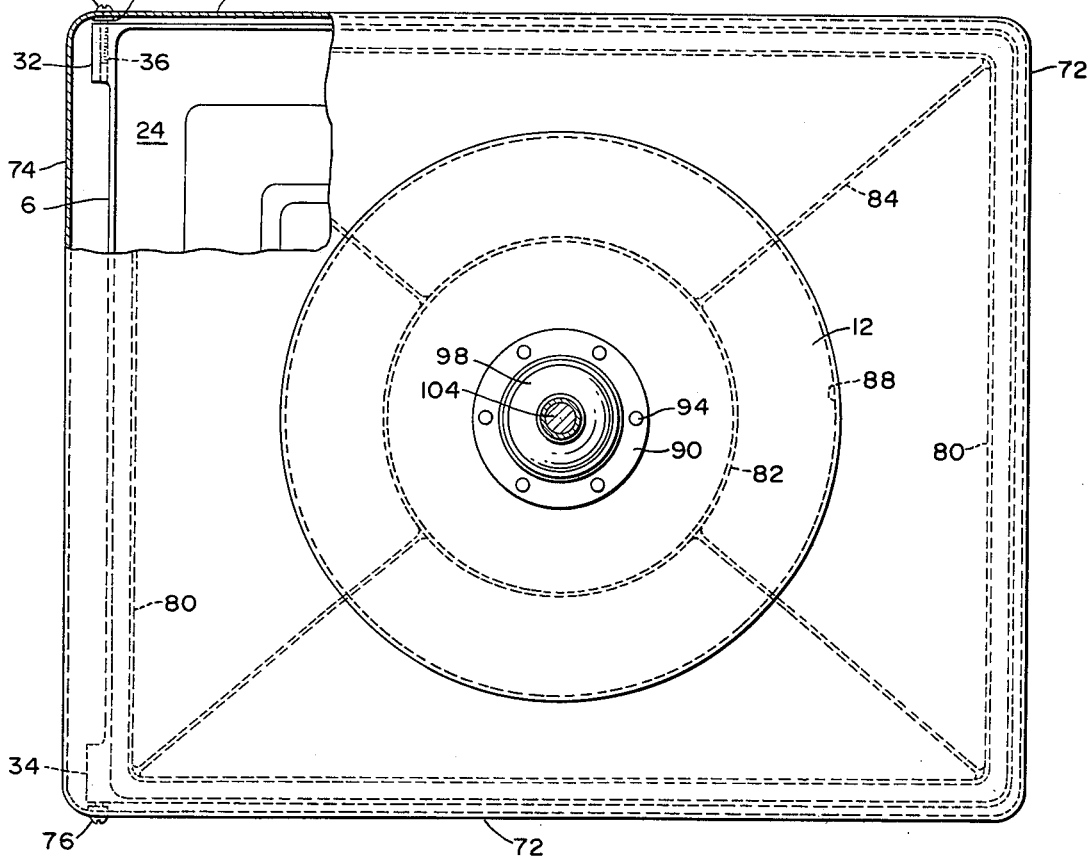
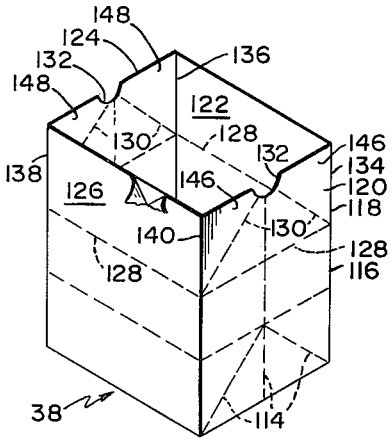
FIG. 7
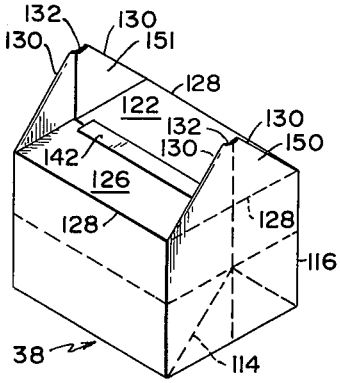
FIG. 8
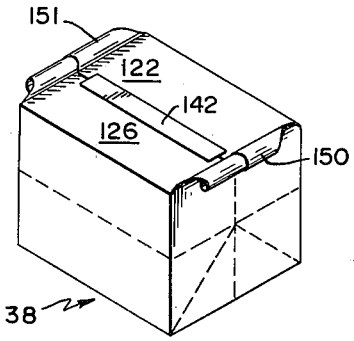
FIG. 9

RECEPTACLE FOR WASTE MATERIAL

This is a division of application Ser. No. 138,482, filed Apr. 29, 1971, now U.S. Pat. No. 3,779,157.

BACKGROUND OF THE INVENTION

This invention is an improvement over the copending U.S. patent application, Ser. No. 20,974, now Pat. No. 3,675,810, filed Mar. 19, 1970 in the names of Thorvald S. Ross, Jr. and Dante V. Consalvo. In that copending application, it is pointed out that in today's times trash disposal (including segregation, storage, etc.) is already a worldwide problem and threatens to become more severe. Part of this problem occurs because of the space occupied by empty containers such as cardboard boxes, tin cans, and bottles. In the home itself, and in stores and industries, the space occupied by such empty containers is voluminous, and this is particularly so in crowded apartment houses and residential areas. Another problem is that of preparing such trash for easy and efficient carting to dumps or recycling centers for disposal.

Therefore, an easy to use, convenient, relatively low cost, and foolproof means for solving the problem is greatly needed.

Already on the market for homes is a mechanized trash compactor which, however, must either be permanently wired into the household as a permanent installation, or must be plugged in an electrical outlet. The units are relatively expensive, have many moving parts with potential maintenance requirements, and many families may not be able to afford such devices. It is also to be noted that there is a need for a trash compaction system which on a low cost basis permits and encourages segregation of trash at the household level, in compacted form, such as glass, ferrous materials, aluminum, plastics, cellulosic materials, etc.

With the rapid decrease of available free land for dumps, burial of non-compacted trash in the so-called land-fill method is an inefficient use of the land. Compacted trash will take much less space.

It is also to be noted that a problem arises in that much trash is contained in non-biodegradable materials for deposit in dumps. Bio-degradable containers are highly desirable.

SUMMARY OF THE INVENTION

If a simple apparatus can be designed which primarily is efficient and safe in its operation and by which in addition to householder can separate and compact trash such as cardboard, paper, and empty containers such as bottles and cans, and if the apparatus is relatively inexpensive and easy to use, the householder will be encouraged to use it since it may reduce the frequency of trips by him to the dump or other disposal area. Accordingly, it is the general purpose of this invention to provide such an apparatus. In addition, the compaction makes separation of various classes of trash easier, and their storage more convenient, pending trips to the dump or disposal area. Separation may enhance the economic value of the trash in view of the growing practice of recycling. For example, compacted metal containers such as aluminum and/or ferrous containers in one class for sale to dealers in scrap metal; and glass shards for glass bricks, in another class.

One object of this invention, therefore, is to provide an improved means for receiving trash and compacting it, part of this means being a disposable container removable for holding the compacted trash either for pick-up by rubbish trucks or transportation by the householder himself to the municipal dump, incinerator, or recycling center.

Another object of the invention is the provision of an apparatus of the above class in which cover means are provided through which a device such as a ram may be inserted for compacting the trash in the container, this cover also being provided with means to prevent injury to the user and spread of trash due to the escape of particles of rubbish such as glass particles.

Still another object of the invention is a provision of a funnel overlying the disposable container, the funnel also maintaining the cover in position, and being positioned securely during normal use of the apparatus so that the lower end of the funnel enters into the upper portion of the disposable container.

An object of the invention is the provision of a disposable container for trash, so constructed that it minimizes the amount of the material used in its construction.

Another object of the invention is the provision of an apparatus for the compaction of trash whereby a plurality of containers and holders therefore may be used and a single cover and funnel means and ram which can be used interchangeably with anyone of the containers.

Still another object of the invention is the provision of an apparatus of any of the above classes into which the user may see in order to better control the compaction and observe the condition and level of the contents.

Another object of the invention is the provision of covering means (for receptacle for receiving and crushing trash) in which means are provided for the insertion of a ram into the receptacle through a flexible or articulated joint which prevents the egress of particles of glass, etc.

A further object of the invention is the provision of a disposable container of the above type which provides full enclosure for the compacted trash as well as easily formed upstanding flaps at opposite sides thereof to facilitate handling the loaded container.

A still further object of the invention is the provision of a container of either of the above classes which is made of bio-degradable material.

Other objects, purposes and advantages of the invention will be in part obvious from the description which follows, and in part pointed out hereinafter specifically.

In the accompanying drawings, in which are illustrated several embodiments of the invention;

FIG. 1 is a view illustrating one embodiment of this invention;

FIG. 3 is a plan view of the FIG. 1 embodiment, with a portion of the cover thereof broken away to show certain features of construction;

FIG. 4 is a sectional elevation of a portion of the FIG. 1 embodiment, given to illustrate a feature of construction;

FIG. 5 is a sectional elevation of a portion of another embodiment of the invention;

FIG. 6 is a sectional elevation of a portion of another embodiment of the invention;

FIG. 7 is a view showing a disposable container for the system in open position;

FIG. 8 is a view of the container of FIG. 8 loaded with compacted trash and with the top closed and sealed down, upstanding end flaps being formed by the folding;

FIG. 9 is a view showing the container of FIG. 9 with the upstanding flaps thereof rolled down in order to provide hand-grips;

FIG. 10 is a view of a portion of still another embodiment of the invention;

Throughout the drawings, similar reference characters indicate corresponding parts. Also, dimensions of certain of the parts as shown in the drawings may have been modified and/or exaggerated for the purpose of clarity of illustration.

Figure 2:
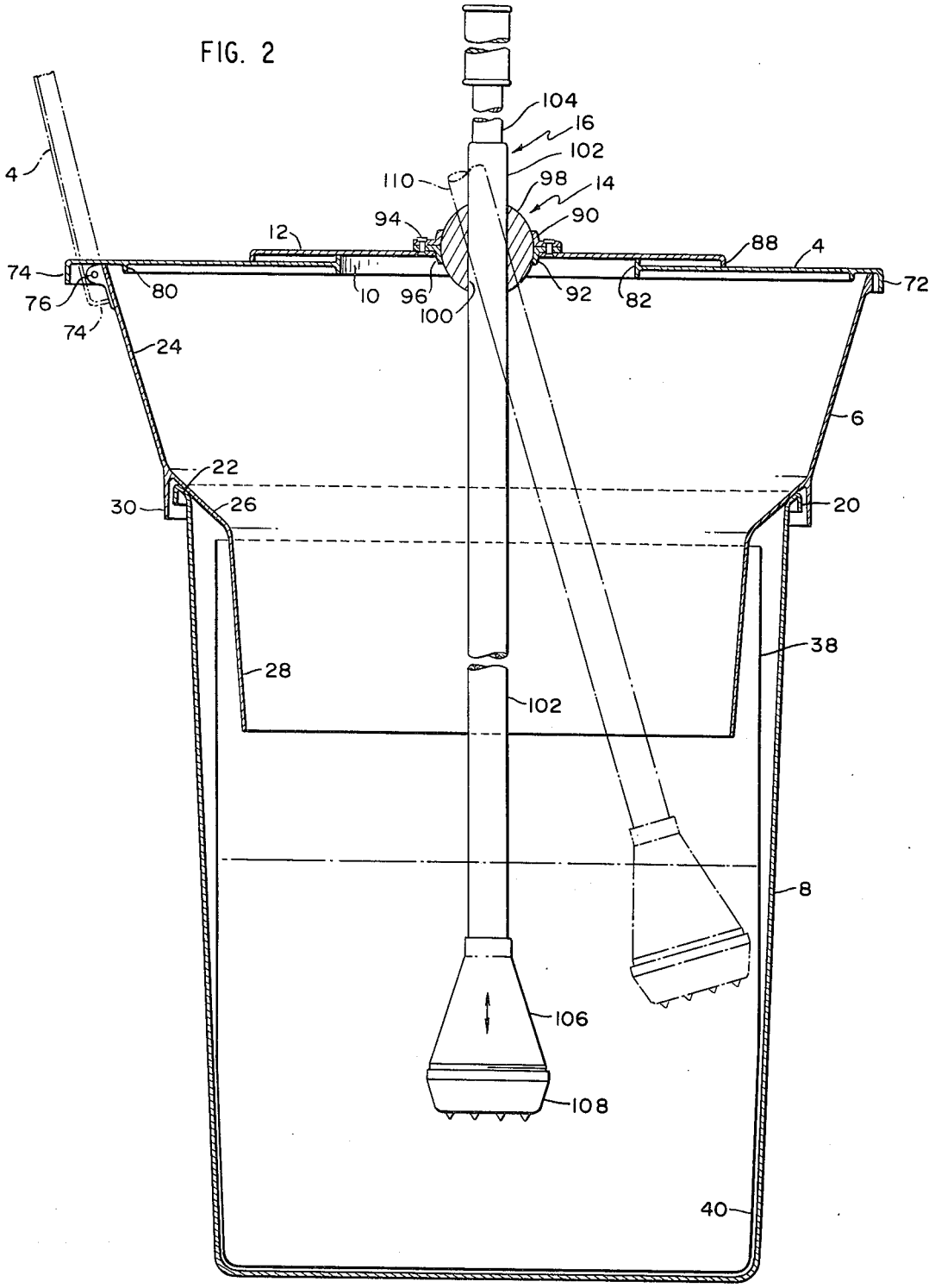
FIG. 2 is a side elevation, in section, of the FIG. 1 embodiment.

Referring now to FIGS. 1 and 2, numeral 2 indicates generally a preferred embodiment of the invention. It comprises a cover 4, a funnel 6, and a holder 8. The cover 4 is provided with an aperture or hole 10 over which lies a protective shield 12.

Shield 12 is provided with a freely movable sealed joint and is preferably the ball and socket joint generally indicated by numeral 14, through which slidably projects the handle 102 of an impactor or ram 16.

Holder 8 is preferably made of high impact synthetic molded resin such as high density polyethylene Type SS60-050 made by Allied Chemical Company, or equivalent material. Of course, it desired, it could be made of a sheet metal such as steel or aluminum. It is generally rectangular in cross-section for a purpose which will be described later, although it could be square if desired. (See FIG. 3 for the plan view.) The walls of the holder slant outwardly from the bottom to the top, thus providing draft to ease removal of a container from the holder. A 2° slant to the vertical has been found to be preferable. The walls of holder 8 are preferably about 0.120 to 0.135 inches thick, and the bottom of the holder preferably is about 0.180 to 0.200 inches thick, if the platic material set forth above is used. Preferably the walls of the holder are somewhat flexible to assist in stripping the container from the holder.

The top edge 20 of the holder is outwardly and downwardly turned to form a lip, and it will be noted that a portion 22 of the lip is at a slant to the wall of the holder 8. By providing the lip 20, a convenient means is provided for carrying the holder itself as well as, if need be, the funnel and cover. Another reason for providing lip 20 will be explained below.

The funnel 6 is made out of synthetic molded resin like that of holder 8, and it comprises three sections 24, 26 and 28, these being rectangular in cross-section and having walls approximately 0.082 to 0.095 inches thick. Bottom section 28 is spaced from the wall of the holder 8 as shown in FIG. 2, the upper section 24 of the funnel is angled inwardly and downwardly in general parallel relationship to the section 28 (although parallelism is not necessary), and the two sections 24 and 28 are joined by the inclined middle section 26. At this point, one feature of the invention will be noted, namely, that the slant of the middle section is the same slant or angle as the portion 22 of the lip 20. Bottom portion 28 tapers inwardly at an angle of approximately 3.5° to the vertical.

Additional to the above, the funnel 6 is provided with a downwardly extending flange or shroud 30 which is long enough to surround the lip 20. Therefore, by means of the shroud 30, and the engagement of the funnel section 26 with the lip portion 22, the funnel is securely but removably seated on the holder 8.

At upper corners 32 and 34 of the funnel are provided bosses through which are provided holes 36. As will be explained later, holes 36 are sized to receive pivot pins which pivotally hold the cover 4 onto the top of the funnel.

Lower portion 28 of the funnel is made long enough so that when the funnel rests on lip 20, the lower portion will extend down into the upper open end of a disposable container 38, freely. Not only does this hold open the container, but it also prevents any trash from falling or getting down between holder and container. The container 38 will be further described below, but it will be sufficient to state here that its bottom portion 40 fits closely against the walls of the holder 8, but due to the sides of the container being generally perpendicular to the bottom of the container, the top portions of these walls are spaced apart from the walls of the holder 8, as shown, due to the slant of the holder walls.

In regard to lip 20, slant portion 22, funnel section 26 and the shroud 30, these are the preferred manner of seating the funnel 6 on holder 8. However, other ways are provided, and a reference to FIGS. 5 and 6 will show two of these ways.

Referring first to FIG. 5, the holder 42 is like holder 8, but in this embodiment is not provided with slanting section 22. Instead it is provided with a simple turned over edge portion 44. The funnel 45 in this embodiment is provided with a flange shroud 46, and in this instance, the angles of the lip 44 and shroud 46 are such as to engage smoothly. Again, the lip 44 provides means for carrying the holder when needed. The funnel has a bottom portion 47 fitting into container 38 as in the first embodiment, and an upper portion 48 as in the first embodiment.

Referring now to FIG. 6, another embodiment is shown. In this case, the funnel 54 has an upper portion 56 and a lower portion 58 which is adapted to fit into the container 38, as in the other embodiments. Portions 56 and 58 are joined by a portion 60 which has a flat bottom portion 62. A shroud 64 is provided on the funnel, the shroud encircling the straight upper edges 65 of the holder 52, as shown in FIG. 6. An outwardly and downwardly extending flange 66 is provided on the holder as a convenient handle for carrying the holder when necessary.

Referring now to FIGS. 2 and 3, cover 4 is transparent (so the user can see into the container for better control of compaction and level of the contents) and is made of a tough, transparent plastic such as clear Cycolac Grade CIT made by the Marbon Division of Borg-Warner Corporation (which is acrylonitrile-butadiene-styrene), and has the downwardly turned edges or lips 72 and 74 on the sides. The material used is about 0.120 to 0.135 inches thick. It will be noted that the fit of the lips 72 on three sides is reasonably close to the top edges of the funnel 6, but that on the fourth side the lip 74 extends beyond the edge of the funnel. Extending through suitable holes provided in lips 72 at opposite corners of the cover are the screws 76, these being fastened to the lips by nuts 78. The shanks of these screws extend into the holes 36, and thus act as pivots for the cover 6. A reference to FIG. 2 indicates the cover having been raised to its upright position, and it will be noted that the lip 74 in the upright position of the cover bears against the wall of the funnel 6 to act as a stop to hold the cover in its upright position.

In conventional manner the cover is strengthened by means of ribs 80 parallel to the edges of the cover. Hole 10 is surrounded by the upstanding rib 82 in order to strengthen the cover at this point, and diagonally extending ribs 84 reach from the corners of the cover to the rib or edge 82 of hole 10. Cover 4 is about 0.120 to 0.135 inches thick.

Shield 12 is circular and is made of transparent, tough synthetic molded resin such as the polycarbonate sold by General Electric Company under the trademark LEXAN. It is about 0.155 to 0.130 inches thick, and has the downwardly turned rim 88 which is the same height as that portion of the rib 82 which projects above cover 4, thus strengthening the shield and providing a smooth slidable engagement of the shield with the cover but with a space therebetween. This engagement minimizes the egress of any particles of glass from the interior of the apparatus, and also minimizes abrasion of the clear plastic surfaces.

A pair of flanges 90 and 92, whose inner faces are portions of hemispheres, are fastened, for example, by means of the rivets 94, to the shield 12 as shown, the shield having a hole 96 through which can project the hemispherical wall of flange 92. When the hemisperical flange 90 and 92 are thus clamped together, it will be noted that they provide a sufficient portion of a spherical socket so as to hold rotatably a ball 98. If desired, either of flanges 90 and 92 can be molded as an integral part of cover 4.

The ball 98 is made of a synthetic molded resin such as a polyacetal resin made and sold by E. I. Dupont de Nemours and Company under the trademark Delrin 500. It is approximately 2½ inches in diameter. The ball is provided with a central hole 100 which is so sized as to permit sliding therethrough the handle portion 102 of the ram 16; for example, a hole approximately 1 inch in diameter.

The preferred form of ram for this invention is that shown in U.S. Pat. No. 3,565,351, issued Feb. 23, 1971. While the ram is not a part of this invention, nevertheless a brief description will be given here, as follows: The ram or impactor comprises the hollow handle 102 in which is slidable shaft 104, the latter being preferably metal. The handle 102 can be metal or a tough, strong synthetic plastic. The handle portion 102 is closed at its bottom by the hollow outwardly extending shell 106 which has attached thereto the steel end-closure member 108. Shaft 104 is long enough so that when it is shoved fully into the handle, the end of it strikes the inside surface of the closure element 108. The kinetic energy of the shaft is thus imparted to member 108. To use the device, the member 108 is placed on trash previously placed in the container 38, the shaft 104 is raised, and then thrust downwardly until the end thereof strikes the closure element 108. The can, bottle or other trash is thus crushed.

A purpose of providing the ball and socket joint 14 is to permit moving of the end 106–108 of the ram so that all portions of the inside of container 38 can be reached thereby at the same prohibiting egress of glass particles, etc. One such a position is shown by the dotted lines 110 on FIG. 2. Also, the size of hole 10 and the slidability of shield 12 with the ball 14 with respect to the hole combine to provide the requisite lateral and angular articulation of the ram.

One feature of the invention is now to be noted. In the preferred embodiment the cover is hinged. Because of the ball and socket joint, and the fact that the ram can slide in the ball, and the shield being slidable, the cover is readily swung to its open position (see FIG. 2) with the ram in place. In this position, the entire top of the apparatus is open for putting trash in the container. Also, it will be found that the weight of the ram will assist in holding the cover open, since the ram will be leaning against the latter in the open position.

Other suitable dimensions of the apparatus thus far described are as follows:

| | |
|---|---|
| Holder height | 20 5/16 inches |
| Holder sides (at top) | 16 1/16 inches long |
| Holder ends (at top) | 13 1/16 inches long |
| Holder sides (at bottom) | 14 5/8 inches long |
| Holder ends (at bottom) | 11 5/8 inches long |
| Funnel length | 12 5/8 inches |
| Funnel top | 20 3/8 × 17 3/8 inches |
| Funnel part 28 | 13 11/16 × 10 11/16 inches |
| Angle 22 | 44° to the vertical |
| Cover overall size | 18 3/8 × 23 1/8 inches |
| Shield 12 | 13 1/16 inches diameter |
| Hole 10 | 8 inches in diameter |

These dimensions are approximate and have been found to work satisfactorily.

Referring now to FIGS. 7, 8 and 9, there is shown one embodiment of a container 38. FIG. 7 shows the container open as used in the holder 8, FIG. 8 shows side panels of the container folded down and sealed when it is loaded with the compacted trash, the folding producing triangular end flaps; and FIG. 9 shows the container with the flaps rolled down to provide handgrips.

The container is made of a double ply of high wet strength. biodegradable paper of adequate thickness such as International Paper Company's 50 pound stock high wet strength Kraft paper. (The example given is approximately 0.005 inches thick per ply.) If desired, it may have conventional moisture resistant layers on the outer and inner surfaces. The container is rectangular in shape and has a bottom which is sealed closed in conventional manner, such as is found, for example, in the bags used by grocery stores, but using a conventional moisture resistant adhesive, as is known to bag makers. It can be folded along the lines indicated by numeral 114 to put it into a flat configuration for storage, etc.

The container comprises two sections, one being the lower section or portion 116 and the other being upper section or portion 118. Upper section 118 comprises the four upstanding panels 120, 122, 124 and 126 joined at edges 134, 136, 138 and 140. At the junction of upper portion 118 and lower portion 116, there is provided an indicium such as line 128 on at least one side (and preferably both sides) of the container (or a set of printed instructions as to where to fold to achieve the FIG. 8 configuration). The line 128 indicates a fill line, and is so positioned that the long side panels 122 and 126 overlap the minimum amount for sealing, when folded down as in FIG. 8. In this manner, by folding the side panels instead of the end panels, considerable saving of paper is obtained since the panels 120, 122, 124 and 126 can all be made of lesser height than if the end panels were to be folded down for sealing. A pair of notches 132 which can be semi-circular in shape are provided in the upper edge of the panels 120 and 124 to facilitate folding them as described below.

When the container is in its collapsed position, it is obvious that the corners 134–140 constitute fold lines which facilitated folding the container into collapsed position. However, corners 134–140 also constitute guide lines for further folding as will now be explained.

Assume that the container has been filled with compacted trash until that trash reaches the plane defined by the fold lines 128, filling having been done by first placing the container in the holder 8 with the funnel 6 thereafter placed upon the holder as shown in FIG. 2, placing trash in the container and thereafter crushing the trash with the ram. After compaction the impactor, cover and funnel are removed, the filled container is folded to the FIG. 8 or 9 condition, and is pulled upwardly and out of the holder 8. This will be found to be easily done.

It has been mentioned above that the container 38 is rectangular rather than square, and because of this and because the long panels 122 and 126 are folded downwardly into the plane of the lines 128, it will be seen that the panel 122 overlaps the panel 126. Once this stage has been reached, then a strip of pressure-sensitive tape 142 is applied to hold the panels in the folded position.

During folding, portions 146 and 148 of the end panels fold inwardly to lie against the central parts of these panels. As a result, there are now left standing the two triangular end flaps 150 and 151. (The reason for the notches 132 is to facilitate such folding.) After this folding has been done, then these residual end flaps are then rolled outwardly as shown in FIG. 9 to provide hand grips whereby the filled container may be readily lifted and carried. It will be noted, that when the handgrips are formed, the thickness of the paper is quadruple within these, thus the handgrips are sufficiently strong because of the double thickness caused by the above described folding, to withstand the weight of the filled container 38.

Mention has also been made that throughout the parts, the material used should be strong, durable, tough synthetic molded resin, both for economy in making the device, and for lightness in weight. Preferably, the material should also be corrosion resistant and readily cleanable. Materials have been described above, but it is obvious that other suitable materials can be used, particularly as such materials may be developed in the future.

In regard to the container, it has been described as being made of strong paper. However, if it is desired to re-use the container, then it should be made of heavier material such as polyethylene-coated bleached white sulfate stock, for example, like that commonly used in milk cartons. Another material might be corrugated box-board.

If desired, either a wetting agent may be sprayed or otherwise distributed on the paper trash in the container prior to being compacted. This will assist in compacting the paper, and minimize the tendency of crushed paper to unfold. Also, a deodorizing liquid or powder may be used on the trash for minimizing odors therefrom. The wetting agent and deodorizer may be combined in an aerosol spray can, if desired.

Referring now to FIG. 10, there is shown a portion of another embodiment of the invention, it being understood that what is being shown is an alternate holder 152, and that in the full embodiment with it will be used the funnel 6, cover 4 and shield 12 of any of the above described embodiments. In this instance, the holder 152 again can be made of molded plastic and has a bottom 154 and the upstanding sides 156, 158 and 160. These sides are attached at their bottom edges to the bottom 154. The fourth side 162, which is the same side as side 158, is attached to the edge of one of the sides 156 and 160 as shown, by means of conventional hinges 164. A conventional hinged latch mechanism 166 is provided so that when the side 162 is swung to the closed position indicated by the dotted lines 170, it is firmly held to sides 156 and 160 to complete the total enclosure. In this embodiment, which may be found preferred for some markets, the sides 156, 158, 160 are perpendicular to the base 154. Therefore, in order to remove a filled container 38 from the holder, the door or side 162 is unlatched and swung open as shown in FIG. 10 and then the container is removed sideways from the holder.

Figure 11:
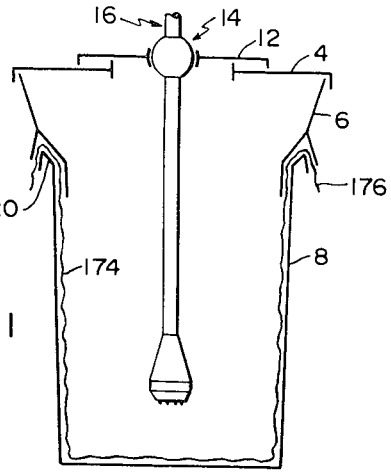
FIG. 11 is a diagrammatic cross-section of another embodiment of the invention showing use of a different kind of container.

Referring now to FIG. 11, there is shown another embodiment of the invention which is like the FIG. 1 embodiment except that it uses a different container. In this embodiment, the cover 4, funnel 6, holder 8, shield 12, joint 14 and ram 16 are the same as used in the FIG. 1 embodiment. (This drawing is given in diagrammatic form for simplicity, the details as to thicknesses and other dimensions, as well as other features, will be apparent from the teaching as to the FIG. 1 embodiment.) In this embodiment, the container 174 is a flexible plastic bag such as is commonly available on the market, and is simply unfolded and inserted in the holder 8 as shown. The top edge 176 is folded down and outwardly over the lip 20 as shown, and the funnel 6 is then inserted into the container and rests on the top of the holder as in the FIG. 1 embodiment. If desired, the downwardly turned edge or cuff 176 may be retained to prevent it from slipping back into the container, for example, by tying a cord around it. However, the weight of the funnel and the cover will keep the edge 176 from pulling back into the holder.

In order to use conventionally sized bags, the holder and thus the funnel and cover are so dimensioned that the container 174 fits closely about the inside wall of the holder 8. As thus backed up by the wall of the holder, tearing of the flexible bags by shards, etc., will be minimized.

Figure 12:
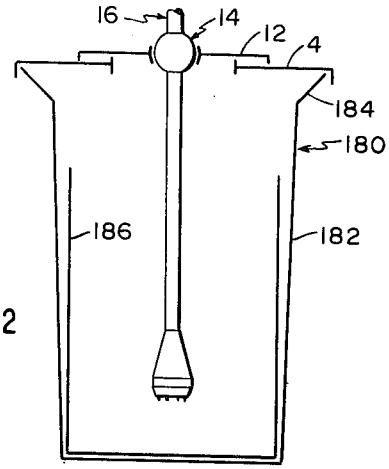
FIG. 12 is a diagrammatic cross-section of the invention, showing another kind of outer holder.

Referring now to FIG. 12, there is shown diagrammatically another embodiment of the invention, in which the holder and the funnel portion thereof are made as an integral unit. Referring to the Figure, the unit is indicated generally by numeral 180, and comprises the lower portion 182 and the upper portion 184. Preferably the upper portion tapers outwardly as shown to provide a funnel-like aspect to facilitate the placing of trash into the receptacle. Cover 4 may be hinged to the open end of the holder.

Stationed in the receptacle 180 is a container 186 which may be like the container 38, or may be taller as shown. In view of the fact that there is no funnel end which assists in holding open the upper end of the container, it is preferred that the container be made of a stiffer material such as paper board or box board so that it will be somewhat self-supporting.

The holder 180 is tapered to provide the draft expressed as preferable in the FIG. 1 embodiment. This being the case, it is preferred that the container 186 fit closely to the inner walls of the holder 180 at least for a portion of the height of the container, in order to back up the walls of the latter against the impact of trash being compacted.

If desired, or course, the funnel-like entrance 184 need not be provided, and the whole holder 180 may be made larger and straight sided from top to bottom with the cover 4 sitting on top. Also, if desired, instead of the container 186 a container similar to that of FIG. 11 may be used, in which case the container will extend up and over the edges of the holder as shown in FIG. 11. As in the FIG. 1 embodiment, the cover 4, shield 12, joint 14 and ram 16 are provided.

Figure 13:
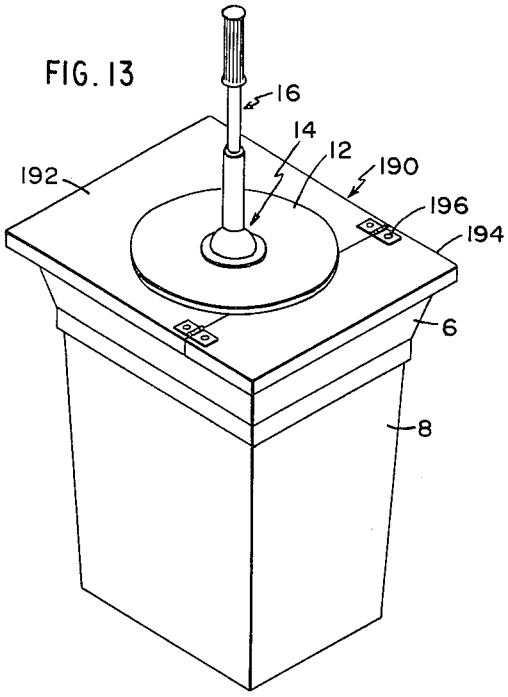
FIGS. 13 and 14 are diagrammatic views of another embodiment of the invention.
Figure 14:
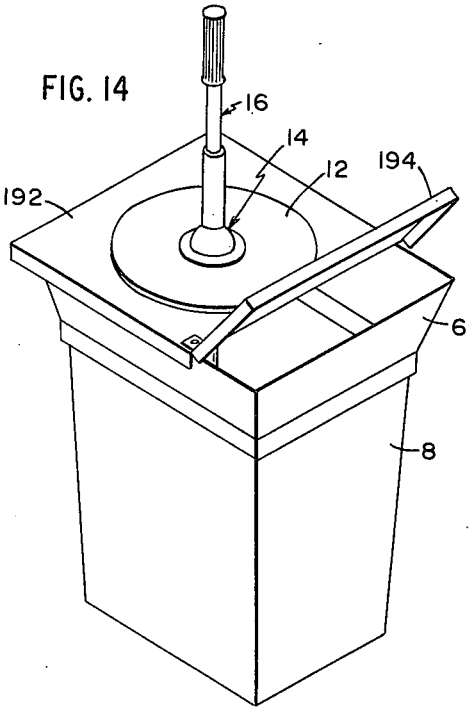

Referring now to FIGS. 13 and 14, another embodiment of the invention is shown which is like the FIG. 1 embodiment as to the funnel 6, holder 8, shield 12, freely movable joint 14, and ram 16. The embodiment is illustrated in perspective, and within the embodiment the same container 38 is to be used as that of the FIG. 1 embodiment. A hole 10 is provided in the cover 190 as is the case of the cover 4, and the shield 12 with its ball and socket joint and ram is slidable with respect to this hole.

However, in this embodiment, the cover is different in one respect from the cover 4 of the FIG. 1 embodiment, as follows:

The cover 190 in this instance is in two parts: a major part 192 and a door part 194. The door 194 is pivoted in some suitable manner to part 192, such as by the hinges 196, to permit the door to be opened as shown in FIG. 14 for the insertion or rubbish into the holder and its container. It will be noted particularly that because of the lateral slidability of the shield 12 in the hole 10, shield 12 and ram 16 can be moved laterally (see FIG. 14) to a position out of the way of the door 194 when it is opened. Also, the pivoting elements or hinges 196 should be far enough out at the ends of the joint between door and part 192 so as not to interfere with the free slidability of the shield 12 in all lateral directions with respect to the cover.

Figure 15:
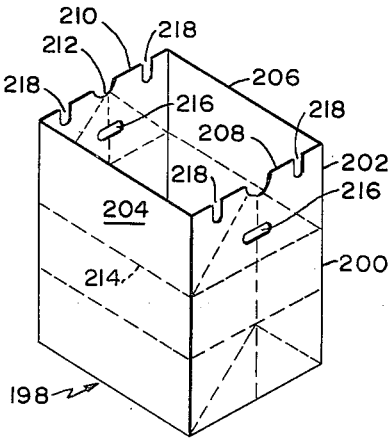
FIGS. 15 and 16 are diagrammatic views of another container for the invention.
Figure 16:
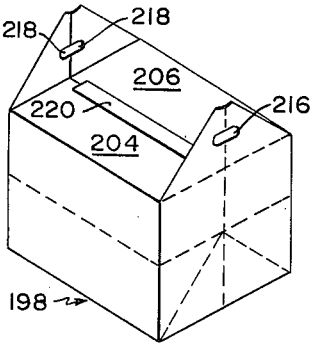

Referring now to FIGS. 15 and 16, there are shown diagrammatic views of another container 198 for the invention, which is similar to the container shown in FIGS. 7 and 8 in that it is made of the same material, and has the same bottom portion 200 and upper portion 202. Elongated side panels 204 and 206, and the end panels 203 and 210 are joined at their edges to form the upper portion 202. If desired, notches 212 may be provided at each of the end panels 208 and 210 to facilitate folding. As in the FIGS. 7 and 8 embodiment, suitable indicia such as the lines or marks 214 are provided on at least one side of the container to indicate a fold line.

Container 198 differs from the container of FIGS. 7 and 8 in that hand-holes 216 are provided in the end panels 208 and 210. Notches 218 are provided at the upper edges of the end panels, so that when the side panels 204 and 206 are folded downwardly as shown in FIG. 16 to permit sealing by tape 220, the notches 219 match or align with the hand-holes 216. Thus, just as in the FIGS. 7 and 8 embodiment, triangular flaps are formed, but in this instance the triangular flaps are provided with the reinforced and strengthened hand-holes 216 in order to facilitate carrying the container with its load of compacted trash.

Of course, if desired, the assembly of holder, funnel, cover and ram can be used without the container. If such use is made, then after the trash is compacted in the holder, the cover and funnel assembly is removed (and the ram) and the trash is then either dumped into another container, or the holder with its compacted contents is taken to the dump where the trash is thrown away. The holder is then reusable. For segregation, a number of holders (with or without containers) can be used, as above.

Regardless of whether the particular holders and/or containers of the system are used, the use of the covers 4 or 190 together with the freely movable joint 14 and the ram 16 will provide an extremely convenient, rapid, and safe method of compacting trash in whatever holder and/or container is used.

It will also be seen that the invention provides a temporary storage deposit for compacted trash which is fully enclosed and therefore prevents or at least minimizes the escape or odors, and access by animals and bugs to the trash.

In view of the above it will be seen that the several objects of the invention are achieved and other advantageous results attained.

It is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not limitation.

As many changes could be made in the above constructions without departing from the scope of the invention, it is intended that all matter contained in the above description or shown in the accompanying drawings, shall be interpreted as illustrative and not in a limiting sense, and it is also intended that the appended claims shall cover all such equivalent variations as come within the true spirit and scope of the invention.

We claim:

1. A rectangular container having sides, ends, a bottom, and an opening at the top, the material of the container being a foldable sheet material, the sides and ends being connected at the vertical corners of the container, each side and end comprising a foldable lower portion and a foldable upper panel portion comprising side and end panel portions, said side and end panel portions also being connected to each other along their entire vertical edges, the side panel portions being longer than the end panel portions and of such vertical width as to overlap a minimum amount and yet sufficiently to allow sealing the container when the longer side panel portions are folded toward each other into a horizontal plane; and the end panels forming upstanding triangular flaps when the side panels are in their horizontal plane, said upstanding flaps forming handles adapted to be gripped by the user of the container for carrying the latter, and are provided with hand-holes; each end panel integrally having a central section and two outer sections, the sections being integral with each other, the two outer sections being foldable to lie against the central section, the central section being provided with a hand-hole, and the upper edge of each outer section being provided with notches shaped to be complementary to at least a portion of said hand-hole when the outer sections are folded against the central section thereby to reinforce the latter.

2. The container of claim 1 in which the material of the container is biodegradable.

3. The container of claim 1 in which at least one side or end of the container is provided with an indicium indicating a fold line for guiding the user in folding said side panels into said horizontal plane to seal the container and to provide said flaps.

4. The container of claim 1 having a horizontal fold indicium on at least one side or end to indicate said upper panel portion, and diagonal fold lines extending upwardly and inwardly along the end panels from the corners of the container approximately from the points where a horizontal plane containing the said horizontal fold indicium intersects said corners, to a point approximately at the center of the top edge of the end panels, to facilitate folding of the side panels downwardly and inwardly to lie in said horizontal plane across the container to provide said triangular-shaped upstanding end flaps.

5. The container of claim 4 in which said horizontal fold indicium is so placed with respect to the upper edge of the unfolded upright container that when said side panels are folded downwardly and toward each other in said horizontal plane, their edges will overlap said amount to provide a sealable seam.

* * * * *